US008199011B2

(12) United States Patent
Lu

(10) Patent No.: US 8,199,011 B2
(45) Date of Patent: Jun. 12, 2012

(54) LOCK WITH ELECTRIC LOCKING FUNCTION

(75) Inventor: Shao-Shian Lu, Zhongli (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 182 days.

(21) Appl. No.: 12/845,788

(22) Filed: Jul. 29, 2010

(65) Prior Publication Data

US 2012/0025984 A1 Feb. 2, 2012

(51) Int. Cl.
*E05B 45/06* (2006.01)

(52) U.S. Cl. ..... 340/542; 340/545.6

(58) Field of Classification Search ..... 340/542, 340/545.6, 545.1

See application file for complete search history.

(56) References Cited

U.S. PATENT DOCUMENTS

2009/0102652 A1* 4/2009 Diener et al. ..... 340/545.6

* cited by examiner

*Primary Examiner* — Shirley Lu

(74) *Attorney, Agent, or Firm* — Alan Kamrath; Kamrath IP Lawfirm, PA

(57) ABSTRACT

A lock includes a case receiving a driving device having a driving member. A connecting member is connected to the driving member to move therewith. The driving device can be actuated to move the connecting member between upper and lower positions to control alignment of a distal end of a locking member and a passageway of an unlocking member. A first detecting member is mounted in the case and operatively connected to the connecting member. A second detecting member is mounted in the space and connected to a burglar alarm system. When the distal end of the locking member is misaligned with the passageway, the first detecting member is in a conductive state and turns on the burglar alarm system. When the distal end of the locking member is aligned with the passageway, the first detecting member is in a non-conductive state and turns off the burglar alarm system.

9 Claims, 11 Drawing Sheets

LOCK WITH ELECTRIC LOCKING FUNCTION

BACKGROUND OF THE INVENTION

The present invention relates to a lock and, more particularly, to a lock that can be electrically locked or unlocked.

There is a wide variety of locks, and a type of them can be selectively utilized with inner and outer operating devices mounted to inner and outer sides of a door. Such locks generally include a bolt slideable between a retracted position in a case and a locking position beyond the case. Each of the inner and outer operating devices is connected to components in the case. These components of the case can be utilized with inner and outer operating devices of various types. Furthermore, such locks can include a lock cylinder that can be operated through a key for locking or unlocking purposes. Further, the key can be operated to retract the bolt to allow opening of the door.

In some cases, a detection device of exposed type, such as a solenoid switch, infrared sensor device, etc, is mounted to a door and a door frame. In an example, the detection device includes a transmitter mounted to the door and a receiver mounted to the door frame and electrically connected to a burglar alarm system. When the door is opened without authorization while the burglar alarm system is turned on, the receiver sends a signal indicative of unauthorized opening of the door to the burglar alarm system, which, in turn, activates alarm light or siren. On the other hand, the burglar alarm system will not activate alarm light or siren if the door is opened while the burglar alarm system is turned off.

Conventional burglar alarm systems can not be combined into currently available locks such that the detecting devices are exposed on the outer side of the door, and the power cords between the burglar alarm systems and the detecting devices are also exposed on the door or the door frame, resulting in the risk of bypass or deactivation of the burglar alarm systems. Furthermore, locking or unlocking of the conventional locks requires insertion of a key into the lock, which would be troublesome to a user whose both hands are occupied with objects.

Thus, a need exists for a lock can be combined with a burglar alarm system such that the lock can be locked or unlocked without using a key.

BRIEF SUMMARY OF THE INVENTION

The present invention solves this need and other problems in the field of door locks with electric locking function by providing, in a preferred form, a lock including a case adapted to be mounted in a compartment in a door. The case includes a faceplate and a rear wall spaced from the faceplate along a first axis. The case further includes a lateral wall and a lid spaced from the lateral wall along a second axis perpendicular to the first axis. The faceplate, the rear wall, the lateral wall, and the lid together define a space. A latch bolt is received in the space and includes a retractor and a head operatively connected to the retractor. The head is slideable along the first axis between an extended, latching position outside of the case and a retracted, unlatching position in the case. A driving rod is rotatably received in the space and includes an end operatively connected to the retractor. The driving rod is pivotable about the second axis between first and second positions. The head of the latch bolt is located in the extended, latching position when the driving rod is in the first position. The head of the latch bolt is located in the retracted, unlatching position when the driving rod is in the second position. An unlocking member is rotatably received in the space and includes a push end. The unlocking member further includes first and second sides spaced along the first axis. A passageway extends from the first side through the second side. The first side at the push end of the unlocking member abuts the driving rod. The unlocking member is adapted to be operatively connected to an outer operating device mounted to an outer side of the door. The outer operating device is operable to rotate the unlocking member about the second axis between an initial position and a releasing position. The driving rod is located in the first position when the unlocking member is in the initial position. The driving rod is located in the second position when the unlocking member is in the releasing position.

The lock further includes a driving device mounted in the space. The driving device includes a driving member movable along the third axis. The driving device is adapted to be electrically connected to a power supply and to receive electricity from the power supply for moving along the third axis. A connecting member is slideably received in the space and connected to the driving member to move therewith. The connecting member is movable by the driving member between an upper position and a lower position. A locking block is removably mounted to the connecting member and selectively in one of first and second engagement relations with the connecting member. The locking member includes first and second end faces and a periphery extending between the first and second end faces. The first end face faces the connecting member. The second end face faces one of the lateral wall and the lid of the case. An extension extends from the periphery of the locking member and has a distal end. The unlocking member is rotatable by the outer operating device from the initial position to the releasing position when the distal end of the locking block is aligned with the passageway of the unlocking member. The lock is in an unlocking state when the extension is received in the passageway while the unlocking member in the releasing position, allowing the driving rod to rotate from the first position to the second position about the second axis and retracting the head from the extended, latching position to the retracted, unlatching position. The distal end of the locking block abuts the first side of the unlocking member when the distal end of the locking block is misaligned with the passageway of the unlocking member such that the lock is in a locking state prohibiting the unlocking member from being rotated by the outer operating device.

The lock further includes a first detecting member mounted in the space. The connecting member is operatively connected to the first detecting member to control the first detecting member to be in a conductive state or a non-conductive state. The first detecting member is pressed against by the connecting member in the lower position with the first detecting member in one of the conductive state and the non-conductive state. The first detecting member is not pressed against by the connecting member in the upper position with the first detecting member in the other of the conductive state and the non-conductive state. A second detecting member is mounted in the space. The second detecting member is adapted to be connected to a burglar alarm system. The head of the latch bolt operatively connected to the second detecting member to control the second detecting member to be in a conductive state or a non-conductive state. The second detecting member is not pressed against by the head, in the extended, latching position with the second detecting member in the non-conductive state. The second detecting member is pressed against by the head in the retracted, unlatching position with the second detecting member in the conductive state.

When the connecting member is in the upper position, the distal end of the locking member is in one of alignment and misalignment with the passageway of the unlocking member. When the connecting member is in the lower position, the distal end of the locking member is in the other of alignment and misalignment with the passageway of the unlocking member.

When the distal end of the locking member is in misalignment with the passageway of the unlocking member, the first detecting member is in the conductive state and turns on the burglar alarm system. When the distal end of the locking member is in alignment with the passageway of the unlocking member, the first detecting member is in the non-conductive state and turns off the burglar alarm system.

The burglar alarm system activates an alarm when the burglar alarm system is on and the second detecting member is in the conductive state. The burglar alarm system does not activate the alarm when the burglar alarm system is on and the second detecting member is in the non-conductive state.

The present invention will become clearer in fight of the following detailed description of illustrative embodiments of this invention described in connection with the drawings.

DESCRIPTION OF THE DRAWINGS

The illustrative embodiments may best be described by reference to the accompanying drawings where.

Figure 1:
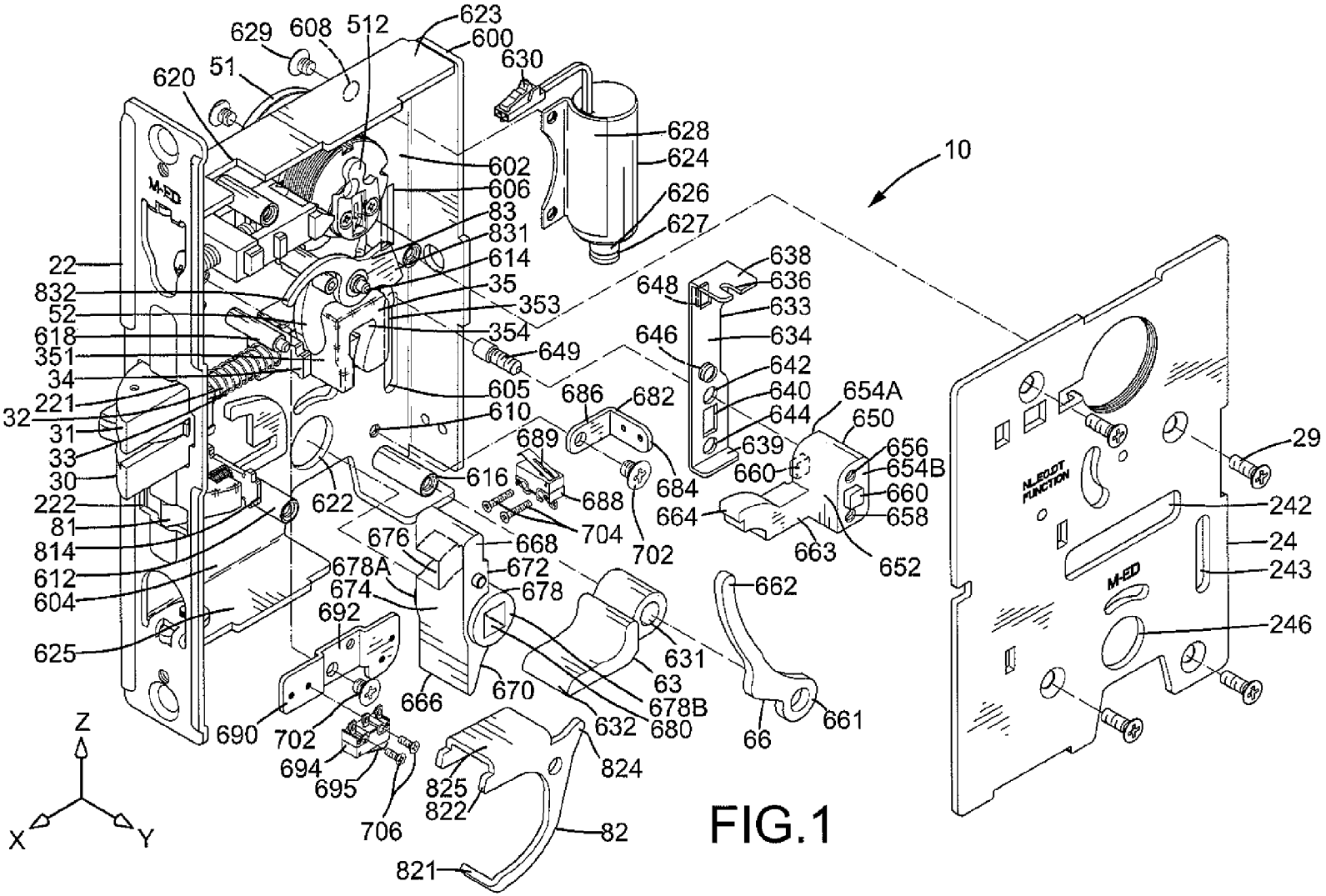
FIG. 1 shows an exploded, perspective view of a lock according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "lower", "upper", "end", "portion", "section", "annular", "outward", "spacing", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A lock according to the preferred teachings of the present invention is shown in the drawings and generally designated 10. According to the preferred form shown, lock 10 includes a substantially parallelepiped-shaped case 600 having a faceplate 22 and a rear wall 23 spaced from faceplate 22 along a first axis X. Case 600 further includes a lateral wall 604 extending between first edges of faceplate 22 and rear walls 23. Case 600 further includes a lid 24 removably mounted to second edges of faceplates 22 and rear walls 23. Lid 24 is spaced from lateral wall 604 along a second axis Y perpendicular to first axis X. Case 600 further includes upper and lower walls 623 and 625 spaced along a third axis Z perpendicular to first and second axes X and Y. Faceplate 22, rear wall 23, lid 24, lateral wall 604, and upper and lower walls 623 and 625 together form case 600 and define a space 602. Lateral wall 604 includes first and second guiding slots 605 and 606 spaced along third axis Z and each extending from an inner face through an outer face of lateral wall 604 along second axis Y. First guiding slot 605 is located below second guiding slot 606 along third axis Z. Lateral wall 604 further includes a hole 610 and a hub hole 622 both of which extend from the inner face through the outer face of lateral wall 604 along second axis Y. Hole 610 is spaced from and below first guiding slot 605 along third axis Z. Hub hole 622 is spaced from hole 610 along first axis X. Case 600 further includes a plurality of engagement pegs 612 extending from the inner face of lateral wall 604 along second axis Y. In the most preferred form shown, each engagement peg 612 has a screw hole in an end face thereof. Furthermore, first, second, and third pegs 614, 616, and 618 are formed on the inner face of lateral wall 604 and extend along second axis Y. First peg 614 is substantially at the same level as an intermediate portion of second guiding slot 606 along third axis Z. First peg 614 is spaced from second guiding slot 606 along first axis X. Second peg 616 is spaced from and below hole 610 along third axis Z. Third peg 618 is slightly below first peg 614 along third axis Z and spaced from first peg 614 along first axis X. Upper wall 623 includes a notch 620 extending from an outer face thereof to space 602 along third axis Z. Faceplate 22 includes first and second openings 221 and 222 each extending from an outer face of faceplate 22 to space 602 along first axis X. According to the preferred form shown, lock 10 is mounted in a compartment 110 in an edge of a door 11 with faceplate 22 exposed and fixed to the edge of door 11. Door 11 includes outer and inner sides 13A and 13B. Compartment 110 is formed between and spaced from outer and inner sides 13A and 13B.

According to the preferred form shown, lid 24 includes a slot 242 extending from an outer face to through space 602. Slot 242 has a length along first axis X. Lid 24 further includes a hub hole 246 extending from the outer face thereof to space 602 and aligned with hub hole 622 along second axis Y. Hub hole 246 is spaced from and below slot 242 along third axis Z. A track 243 extends from the outer face of lid 24 through an inner face of lid 24. Screws 29 are extended through lid 24 into engagement pegs 612 to fix lid 24 and to form case 600.

Figure 6:
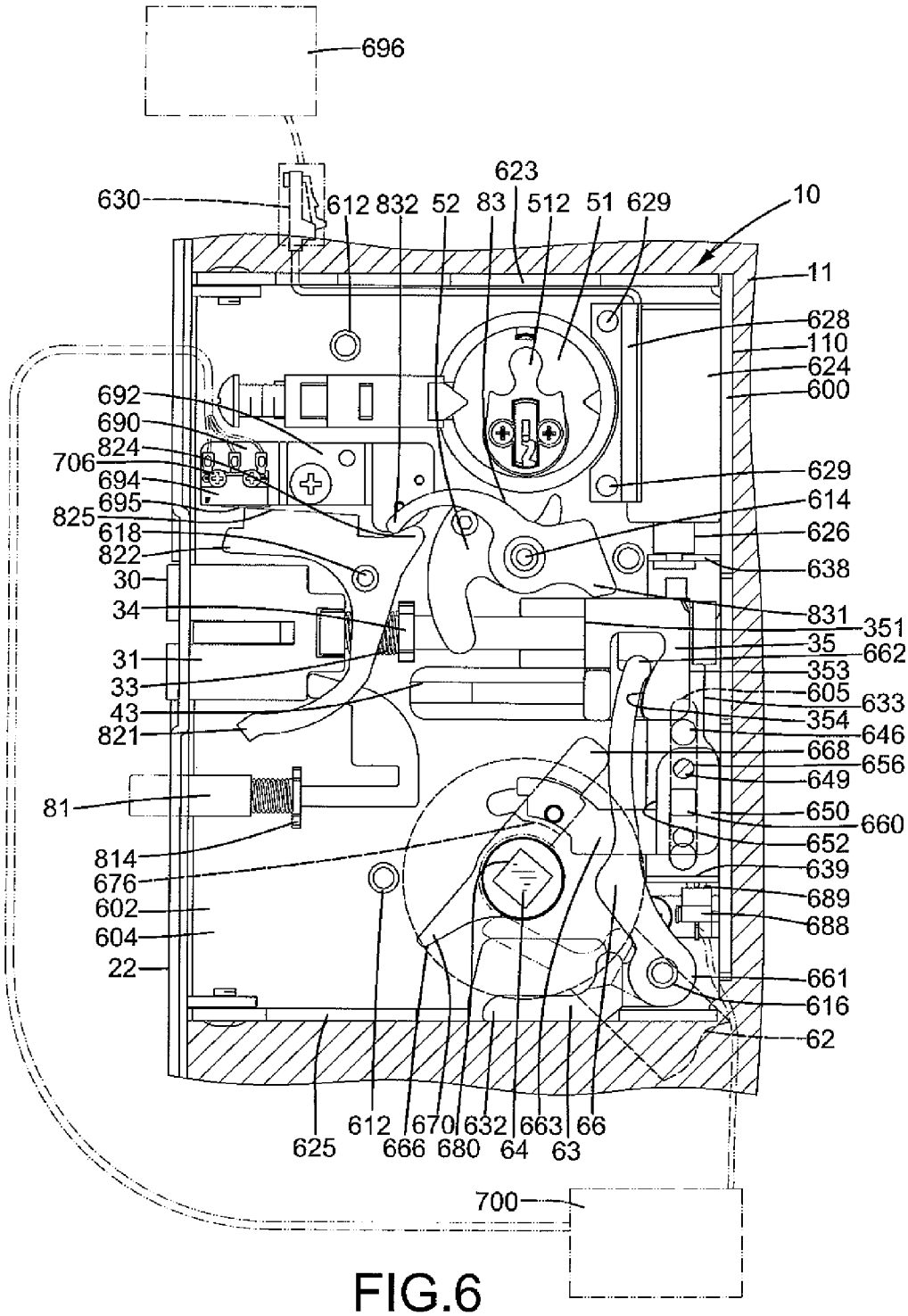
FIG. 6 shows a view similar to FIG. 3 with an outer handle of the lock rotated.
Figure 10:
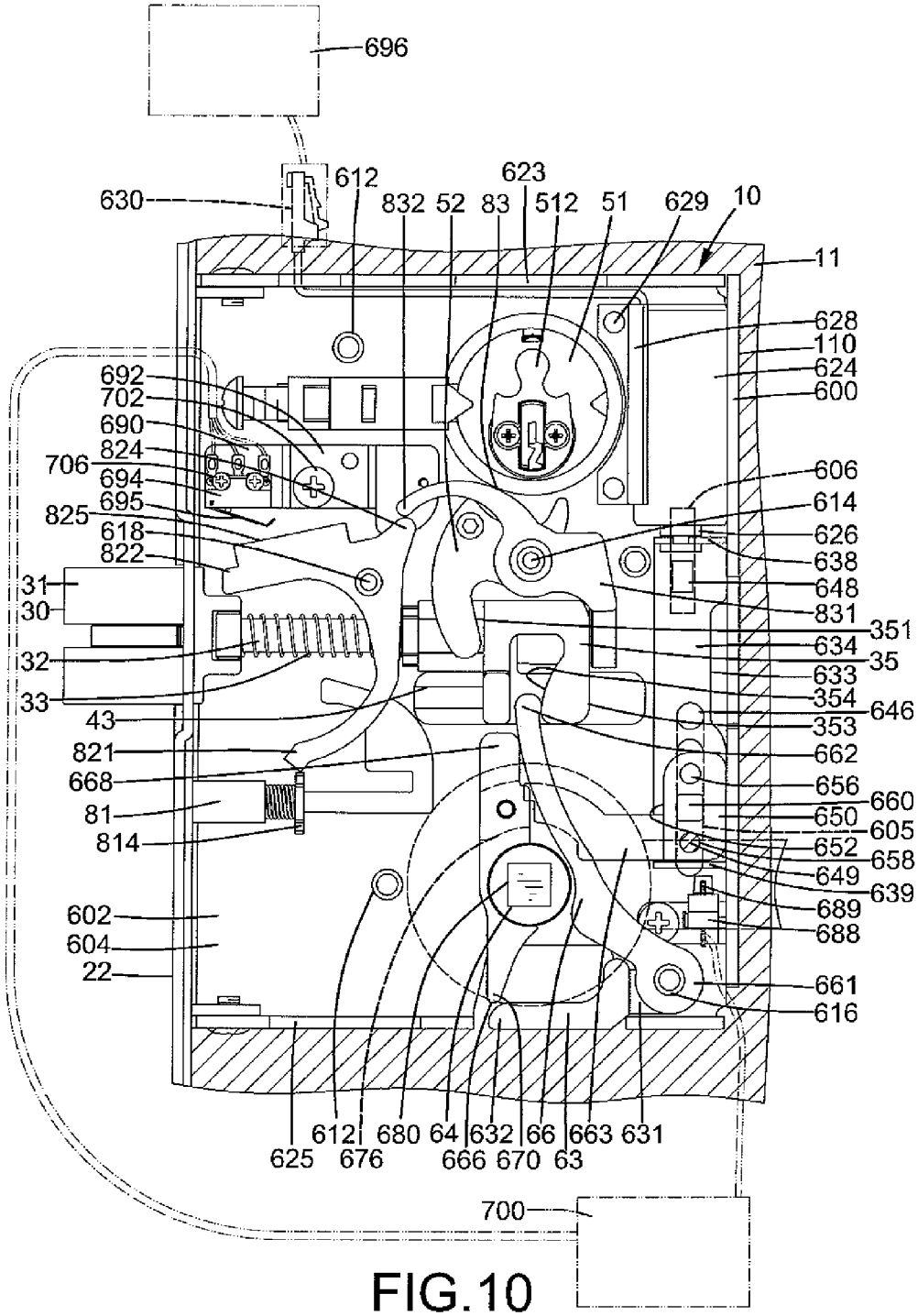
FIG. 10 shows a view similar to FIG. 8 with a driving member moved due to electrification of the driving device.
Figure 11:
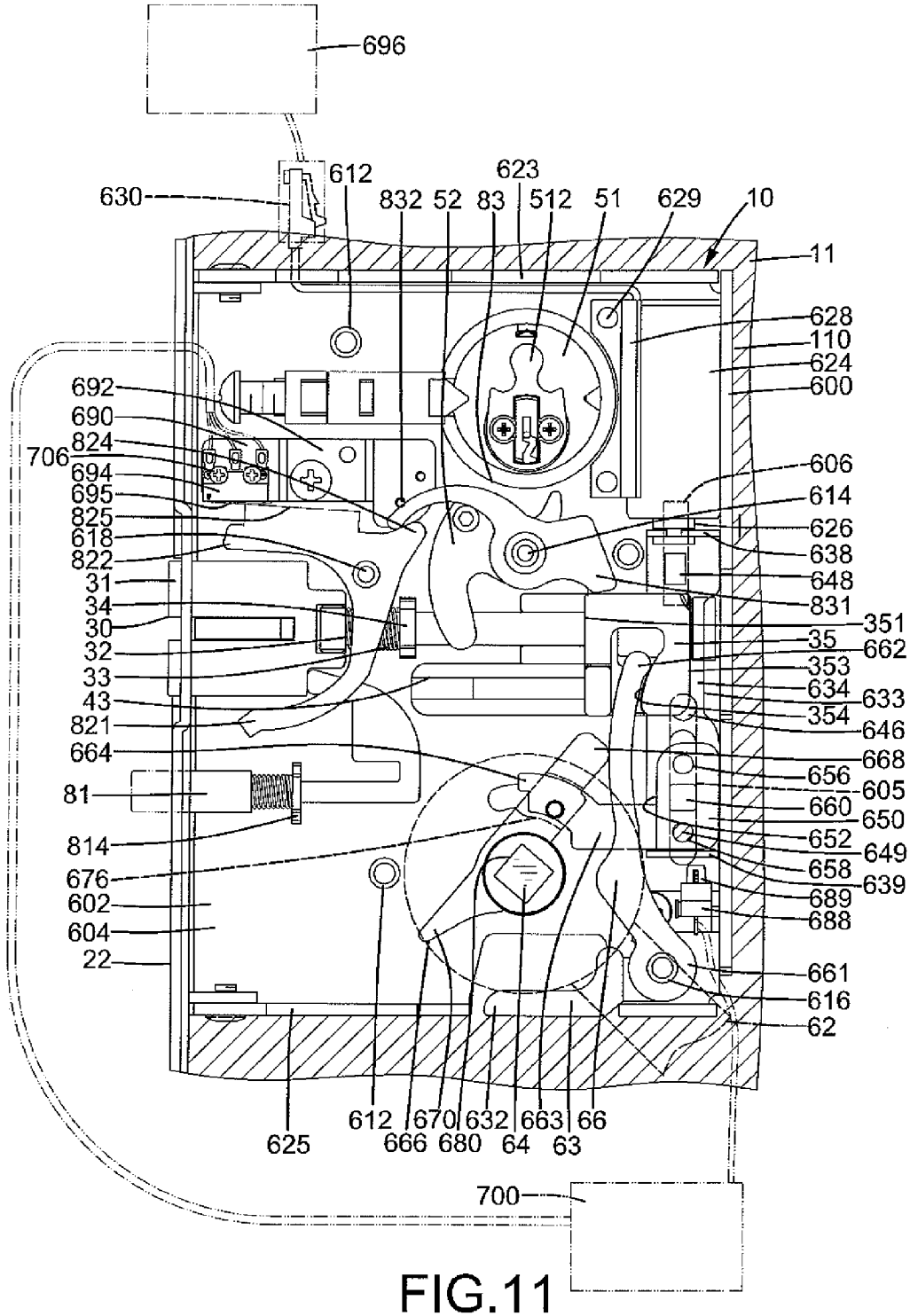
FIG. 11 shows a view similar to FIG. 8 with the lock unlocked through electrification of the driving device and with a latch bolt moved to a retracted, unlatching position by the outer operating device.

According to the preferred form shown, lock 10 further includes a latch bolt 30 having a shank 32 slideably received in space 602 along first axis X. A head 31 is connected to an outer end of shank 32 and extendible through first opening 221. A positioning plate 34 is slideably mounted around shank 32 along first axis X. A spring 33 is mounted between positioning plate 34 and head 31 and around shank 32. A retractor 35 is mounted on an inner end of shank 32 to move therewith and spaced from spring 33 by positioning plate 34. Retractor 35 includes an abutting face 351 facing head 31 and a sidewall 353 facing lid 24. A notch 354 is formed in sidewall 353. In the most preferred form shown, retractor 35 is slideably held between lateral wall 604 and lid 24. Thus, retractor 35 is slideable along first axis X between two positions to cause movement of shank 32 and head 31 along first axis X, allowing movement of head 31 through first opening 221 between an extended, latching position outside case 600 (FIGS. 3, 5, 7, 8, and 10) and a retracted, unlatching position inside case 600 (FIGS. 6 and 11). Note that when latch bolt 30 is moving inward to the retracted, unlatching position, spring 33 is compressed, and retractor 35 is moved along first axis X.

According to the preferred form shown, lock 10 further includes an auxiliary bolt 81 that includes a positioning plate 814 having two sides fixed to lateral wall 604 and lid 24 for resiliently positioning auxiliary bolt 81 such that auxiliary bolt 81 is extendible through second opening 222 between an extended position (see phantom lines in FIGS. 6 and 11) outside of case 600 and a retracted position (FIGS. 3, 5, 7, 8, and 10) inside case 600.

According to the preferred form shown, lock 10 further includes a follower 52 mounted in space 602. Follower 52 is rotatably to first peg 614 of case 600 and has an end that abuts abutting face 351 of retractor 35. Follower 52 is pivotable about second axis Y to push retractor 35, which, in turn, moves head 31 of latch bolt 30 from the extended, latching position (FIGS. 3, 5, 7, 8, and 10) to the retracted, unlatching position (FIGS. 6 and 11).

According to the preferred form shown, lock 10 further includes a key-operated cylinder 51 mounted to lateral wall 604. Cylinder 51 includes a keyway and an actuating plate 512 that is rotated about second axis Y when a key is inserted into the keyway and rotated. Follower 52 is located in a rotating path of actuating plate 512 and abuts abutting face 351 of retractor 35 when head 31 of latch bolt 30 is in the extended, latching position. When actuating plate 512 rotates due to rotation of a key inserted into the keyway, follower 52 pivots about second axis Y and pushes retractor 35 away from first opening 221, moving head 31 of latch bolt 30 to the retracted, unlatching position.

According to the preferred form shown, lock 10 further includes a link 63 having a first end 631 rotatably mounted to second peg 616 and a second end 632. Link 63 can be driven to rotate about second axis Y. A driving rod 66 includes a first end 661 rotatably mounted to first peg 614 and a second end 662 engaged in notch 354 of retractor 35. Driving rod 66 is pivotable about second axis Y between a first position (FIGS. 3, 7, 8, and 10) and a second position (FIGS. 6 and 11).

According to the preferred form shown, lock 10 further includes an unlocking lever 83 mounted in space 602. Unlocking lever 83 includes first and second ends 831 and 832 and an intermediate portion between first and second ends 831 and 832. The intermediate portion of unlocking lever 83 is rotatably mounted to first peg 614 such that unlocking lever 83 can pivot about second axis Y between a third position (FIGS. 3, 5, 7, 8, and 10) and a fourth position (FIGS. 6 and 11). When unlocking lever 83 is in the third position, first end 831 is above second end 832 along third axis Z. On the other hand, when unlocking lever 83 is in the fourth position, first end 831 is below second end 832 along third axis Z. Furthermore, when head 31 of latch bolt 30 is in the extended, latching position and when unlocking lever 83 is in the third position, first end 831 of unlocking lever 83 abuts sidewall 353 of retractor 35.

According to the preferred form shown, lock 10 further includes a stop 82 mounted in space 602. Stop 82 includes a first, hooked end 821, a second end 822, and a protrusion 824 arranged similar to three apexes of a triangle. Stop 82 has a top portion 825 at second end 822. Stop 82 is rotatably mounted to third peg 618 and pivotable about second axis Y between a stop position (FIGS. 3, 7, 8, and 10) and a release position (FIGS. 6 and 11). First end 821 of stop 2 is operatively connected to auxiliary bolt 81. Second end 832 of unlocking lever 83 abuts protrusion 824 of stop 82. When auxiliary bolt 81 moves from the retracted position to the extended position, first end 821 of stop 82 is moved by auxiliary bolt 81 to the release position (FIG. 6). Namely, when head 31 of latch bolt 30 is in the extended, latching position, the auxiliary bolt 81 is in the extended position to position stop 82 in the release position. When auxiliary bolt 81 moves from the extended position to the retracted position, the auxiliary bolt 81 releases first end 821 of stop 82, and stop 82 rotates to the stop position due to the gravitational force acting on stop 82. It can be appreciated that auxiliary bolt 81 is in the retracted position when latch bolt 30 is in the retracted, unlatching position.

According to the preferred form shown, lock 10 further includes an unlocking member 666 mounted in space 602 and having a push end 668 and a connecting end 670 spaced from the push end 668 along third axis Z. Unlocking member 666 further includes first and second sides 672 and 674 spaced along first axis X. An arcuate passageway 676 extends from first side 672 through second side 674. In the most preferred form shown, a center of arcuate passageway 676 is aligned with a center of hub hole 622. Unlocking member 666 further includes a pivotal portion 678 intermediate push end 668 and connecting end 670. Pivotal portion 678 includes first and second end portions 678A and 678B respectively protruding beyond two lateral surfaces of unlocking member 666 along second axis Y. A spindle hole 680 extends from first end portion 678A through second end portion 678B. First end portion 678A is pivotably received in hub hole 622 of case 600. Second end portion 678B is pivotably received in hub hole 246 of lid 24. First side 672 at push end 668 abuts second end 662 of driving rod 66. Connecting end 670 is above second end 632 of link 63. Unlocking member 666 is pivotable about second axis Y between an initial position (FIGS. 3, 7, 8, and 10) and a releasing position (FIGS. 6 and 11).

According to the preferred form shown, lock 10 further includes a driving device 624 having an attachment member 628 mounted to an outer periphery thereof. In the most preferred form shown, attachment member 628 is welded to the outer periphery of driving device 624. Driving device 624 includes a driving member 626 movable along third axis Z. Driving member 626 includes an annular groove 627 formed in a distal end thereof. Driving device 624 includes a coupler 630 electrically connected to a power cord. Fasteners 629 are extended through holes 608 in lateral wall 604 of case 600 and two holes in attachment member 628 to fix driving device 624 in space 602. Coupler 630 extends out of case 600 via notch 620 in upper wall 623 and is electrically connected to a power supply 696 that supplies electricity for actuation of driving device 624. In the most preferred form shown, driving device 624 includes an electromagnetic driving mechanism having a coil. When electricity is supplied from power supply 696 to driving device 624, the coil will generate magnetic force to move driving member 626 inward or outward. Furthermore, a remote control system can be incorporated into power supply 696, allowing electricity supply from power supply 696 to driving device 624 for moving driving member 626 by using a remote control.

According to the preferred form shown, lock 10 further includes a connecting member 633 slideably received in space 602. Connecting member 633 includes first, second, and third sections 634, 638, and 639. Second section 638 and third section 639 are spaced along third axis Z and on opposite ends of first section 634. In the most preferred form shown, first section 634 extends perpendicularly to second axis Y. Second and third sections 638 and 639 are parallel to and spaced from each other and extend perpendicular to third axis Z. First section 634 includes a first face facing lateral wall 604 of case 600 and a second face facing lid 24. First section 634 further includes first and second through-holes 642 and 644 each extending from the first face through the second face of first section 634 along second axis Y. First through-hole 642 is spaced from and above second through-hole 644 along third axis Z. First section 634 further includes a slot 640 extending from the first face through the second face of first section 634 along second axis Y and located intermediate first and second through-holes 642 and 644. First and second protrusions 646 and 648 are formed on the first face of first section 634 and spaced from each other along third axis Z. First protrusion 646 is above first through-hole 642. Second protrusion 648 is above first protrusion 646 and adjacent to second section 638. Second section 638 includes an engaging section 636 in the most preferred form shown as a notch having a peripheral edge engaged with annular groove 627 of driving member 626, allowing joint movement of driving member 626 and connecting member 633. First protrusion 646 is slideably received in first guiding slot 605. Second protrusion 648 is slideably received in second guiding slot 606. Thus, connecting member 633 can be driven by driving member 626 to move along third axis Z between an upper position and a lower position within the length extents of first and second guiding slots 605 and 606 along third axis Z while first and second protrusions 646 and 648 assure stable movement of connecting member 633 and avoid rotational movement of connecting member 633.

According to the preferred form shown, lock 10 further includes a locking block 650 fixed to connecting member 633. Locking block 650 includes first and second end faces 654A and 654B spaced along second axis Y and a periphery 652 extending between first and second end faces 654A and 654B. First end face 654A faces connecting member 633, and second end face 654B faces lid 24. An extension 663 extends from periphery 652 and has a distal end 664. First and second positioning holes 656 and 658 in the most form shown as two screw holes extend from first end face 654A through second end face 654B. A protrusion 660 is formed on first end face 654A and slideably received in slot 640 of connecting member 633 along third axis Z. Another protrusion 660 is formed on second end face 654B and slideably received in track 243 of lid 24 along third axis Z.

According to the preferred form shown, lock 10 further includes an adjusting member 649 in the most preferred form shown as a screw. In a first example of use, adjusting member 649 is extended through first through-hole 642 of connecting member 633 and engaged in first positioning hole 656 of locking block 650 (FIGS. 3-7) such that lock 10 is in a locking state after electrification of driving device 624. In a second example of use, adjusting member 649 is extended through second through-hole 644 of connecting member 633 and engaged in second positioning hole 658 (FIGS. 8-11) such that lock 10 is in an unlocking state after electrification of driving device 624, which are opposite to the first example of use.

Figure 4:
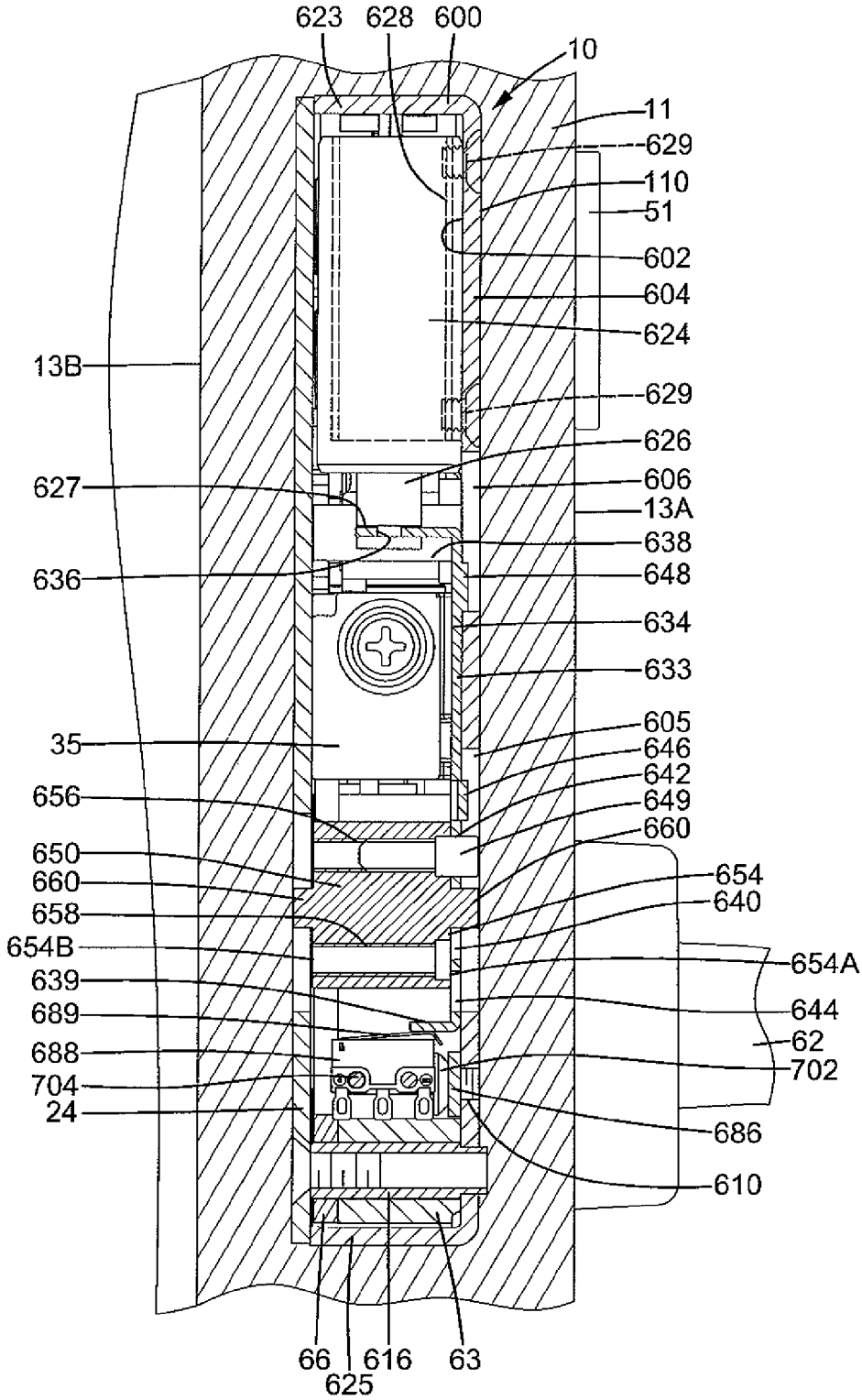
FIG. 4 shows a cross sectional view of the lock and the door of FIG. 2 according to section line 4-4 of FIG. 3.
Figure 5:
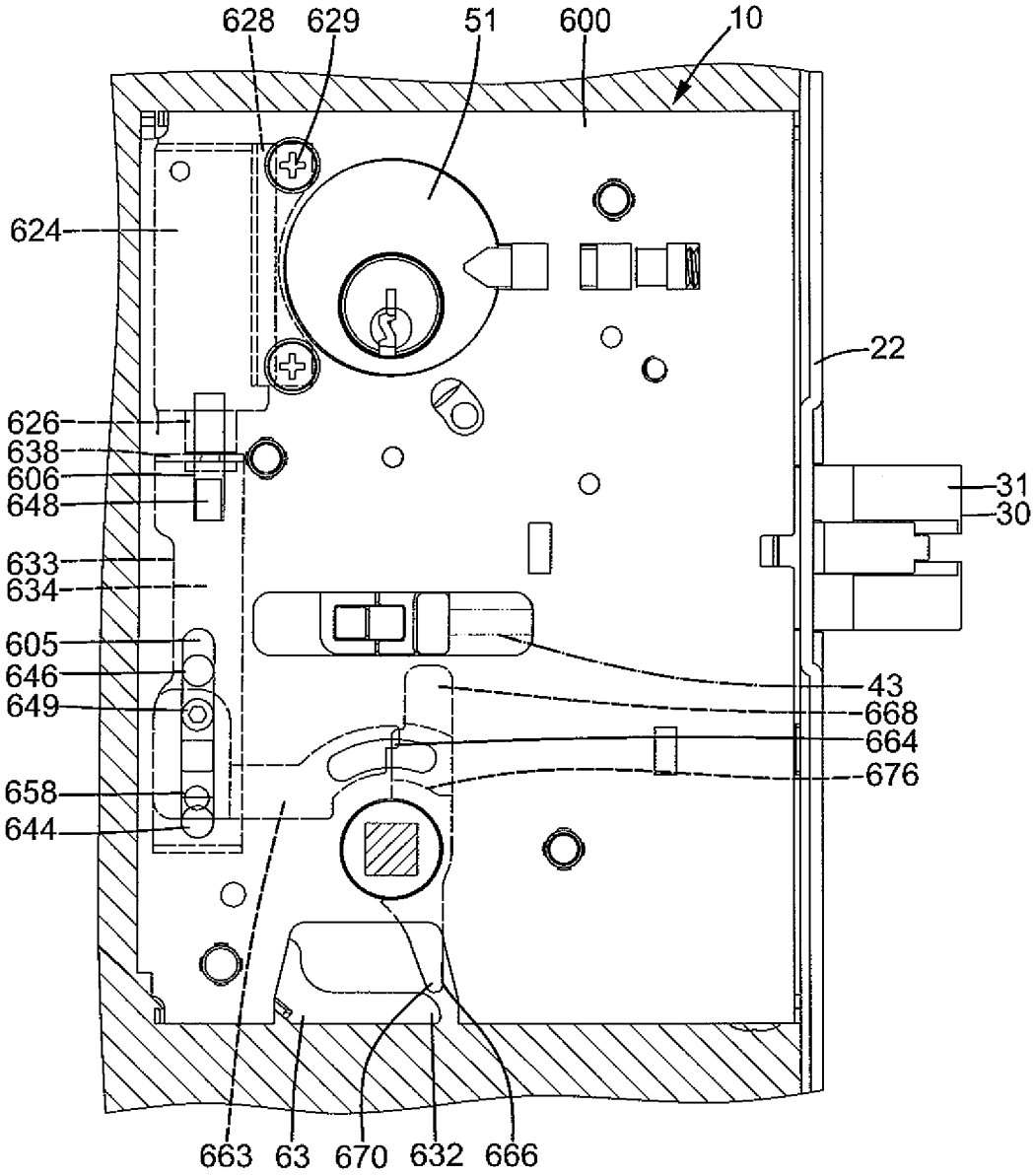
FIG. 5 shows a cross sectional view of the lock and the door of FIG. 2 according to section line 5-5 of FIG. 2.

According to the preferred form shown, lock 10 further includes first and second detecting members 688 and 694 mounted in space 602. First detecting member 688 is fixed to an attachment 682, and a second detecting member 694 is fixed to a mounting plate 690. Attachment 682 includes a first portion 684 perpendicular to second axis Y and a second portion 686 perpendicular to first portion 684 and second axis Y. Attachment 682 is fixed by a fastener 702, such as a screw, extending through second portion 686 into hole 610 of lateral wall 604 of case 600 (FIG. 4). First detecting member 688 includes a pressable actuation plate 689. First detecting member 688 is fixed by two fasteners 704, such as screws, to first portion 684 of attachment 682 such that actuation plate 689 of first detecting member 688 is below third section 639 of connecting member 633 along third axis Z. Mounting plate 690 includes a fixing portion 692 and is fixed by another fastener 702 to lateral wall 604 of case 600. Second detecting member 694 includes an actuation plate 695 and is fixed by two fasteners 706 to fixing portion 692 of mounting plate 690 such that actuation plate 695 of second detecting member 694 is above top portion 825 of stop 82 along third axis Z. In the most preferred form shown, each of first and second detecting members 688 and 694 is in the form of a micro switch having three contacts. Appropriate wiring can be provided to first detecting member 688 (such as selective electrical connection between two of the three contacts) such that an open or closed circuit can be obtained when actuation plate 689 is pressed. Setting of the open or close circuit to provide a locking operation or unlocking operation after electrification of driving device 624 can be selected according to the wiring of first detecting member 688 and can be easily achieved by one having ordinary skill in the art.

According to the preferred form shown, lock 10 further includes an outer operational device 6 mounted to outer side 13A of door 11 and an inner operational device 4 mounted to inner side 13B of door 11. Outer operational device 6 includes an outer handle 62 pivotable about second axis Y. A spindle 64 is attached to outer handle 62 to rotate therewith. An end of spindle 64 is extended through spindle hole 680 of unlocking member 666 (FIGS. 3 and 4) such that unlocking member 666 rotates jointly with outer handle 62.

Figure 2:
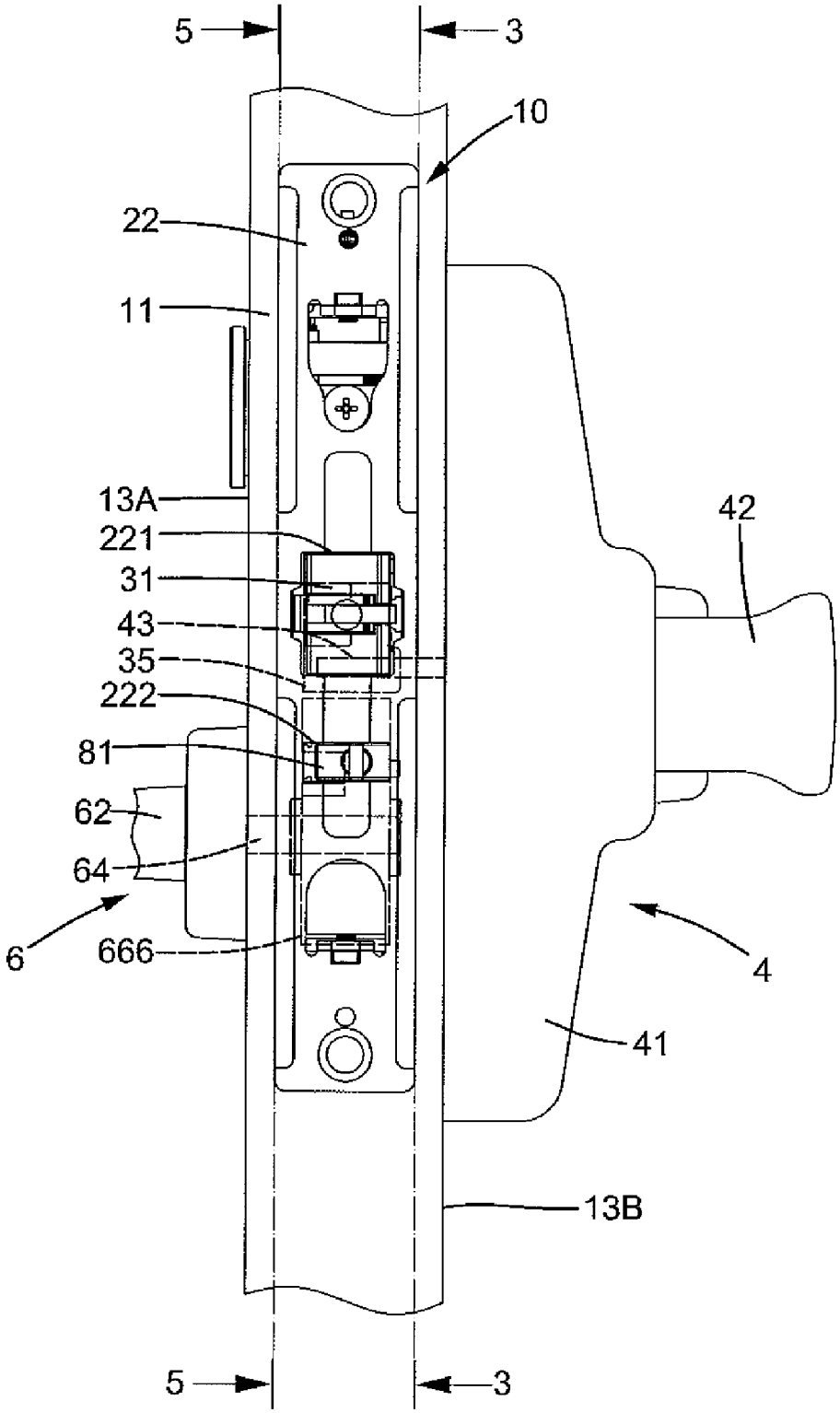
FIG. 2 shows a side view of the lock of FIG. 1 and a door to which the lock is mounted.
Figure 3:
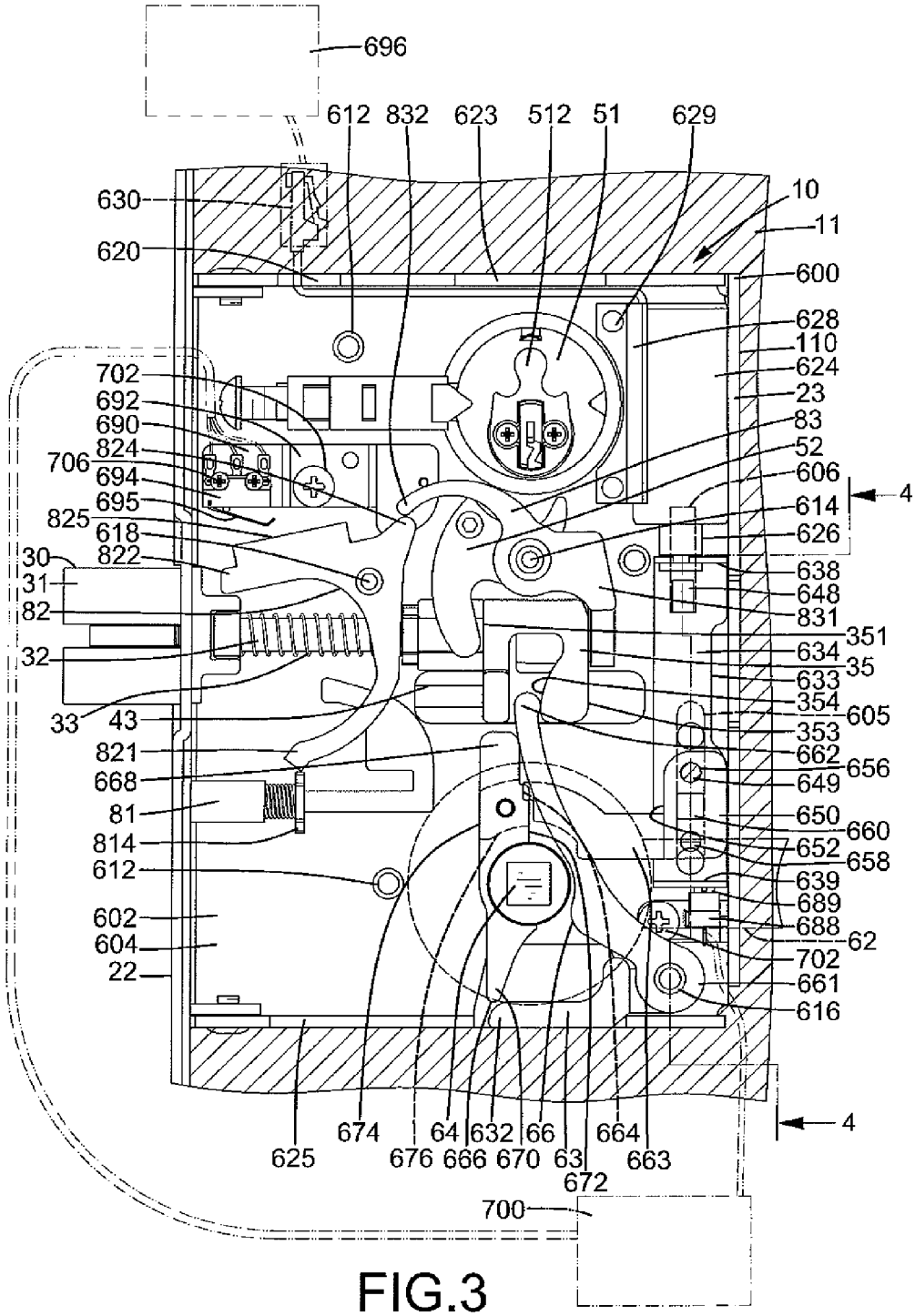
FIG. 3 shows a cross sectional view of the lock and the door of FIG. 2 according to section line 3-3 of FIG. 2 with the lock assembled to be in a locking state through electrification.

According to the preferred form shown, inner operating device 4 includes a housing 41, a pressing bar 42, and a driving rod 43 (FIGS. 2-4). Driving rod 43 is operatively connected to pressing bar 42 and has an end that extends through door 11 and slot 242 of lid 24 into space 602 and that abuts abutting face 351 of retractor 35. When pressing bar 42 is pressed, retractor 35 is moved through transmission of driving rod 43, moving head 31 of latch bolt 30 from the extended, latching position to the retracted, unlatching position. Other forms and shapes of inner operating device 4 can be utilized according to the teachings of the present invention.

Figure 7:
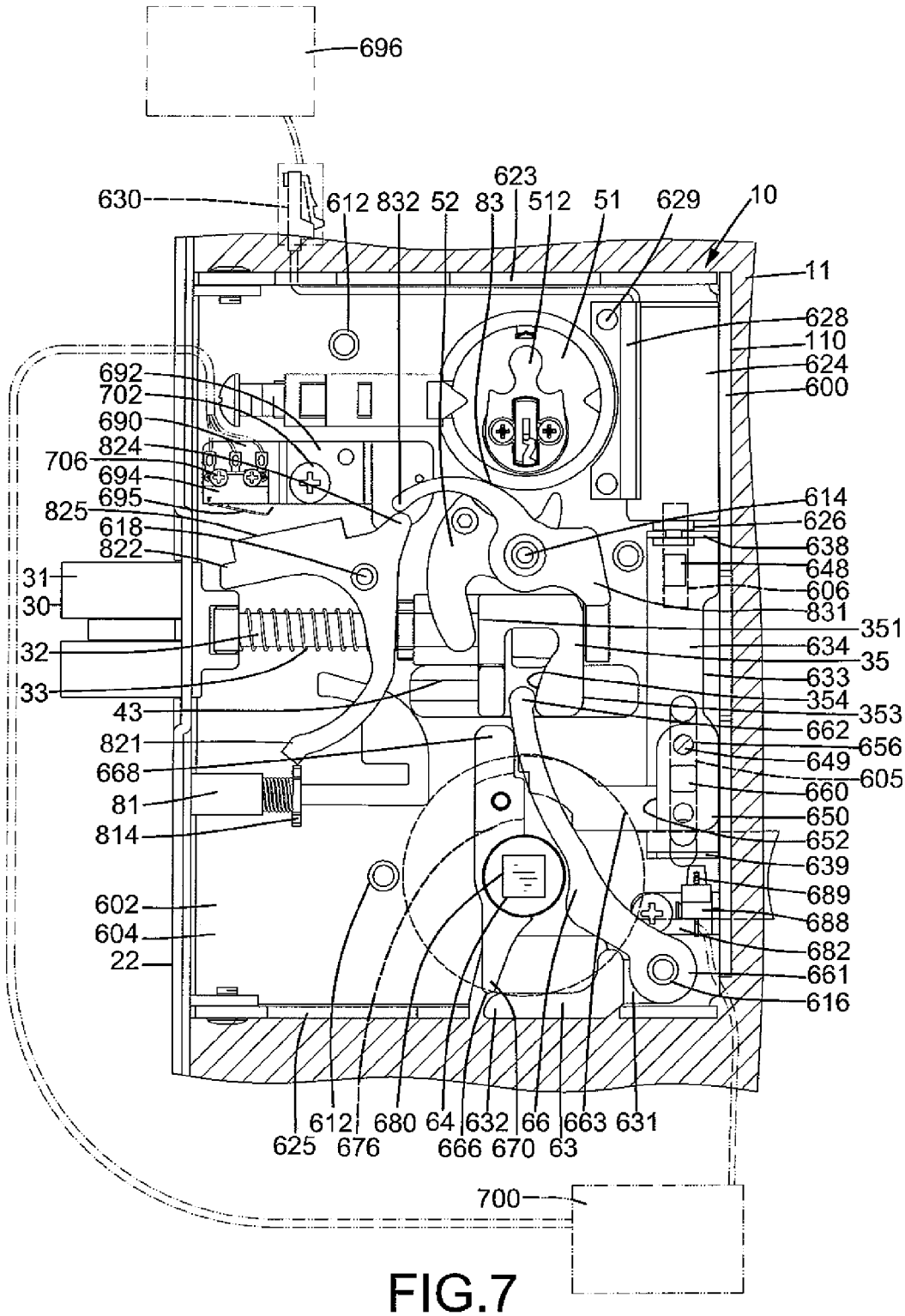
FIG. 7 shows a view similar to FIG. 3 with a driving device in an electrified state.
Figure 8:
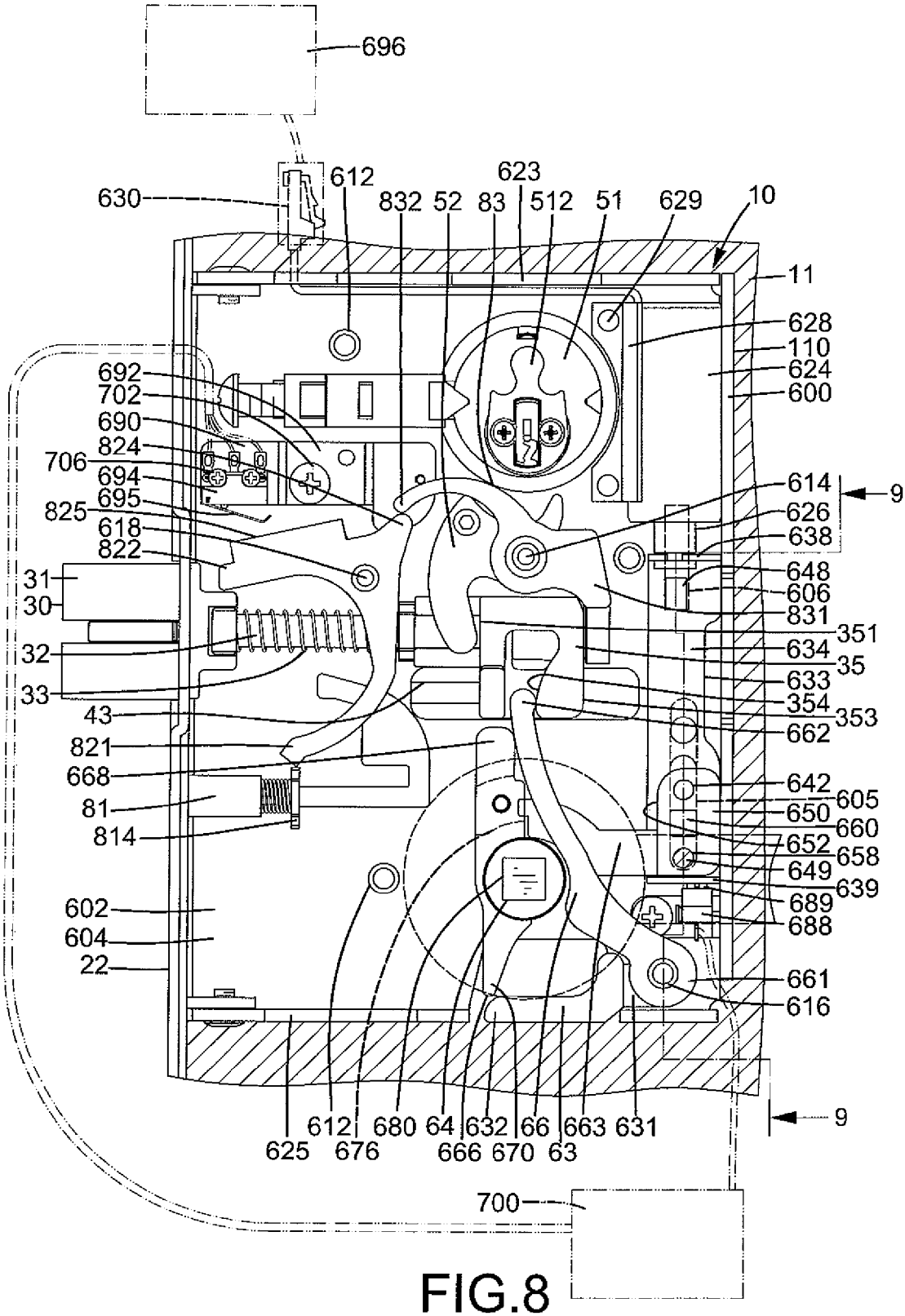
FIG. 8 shows a cross sectional view of the lock and the door of FIG. 2 with the lock assembled to be in an unlocking state through electrification.
Figure 9:
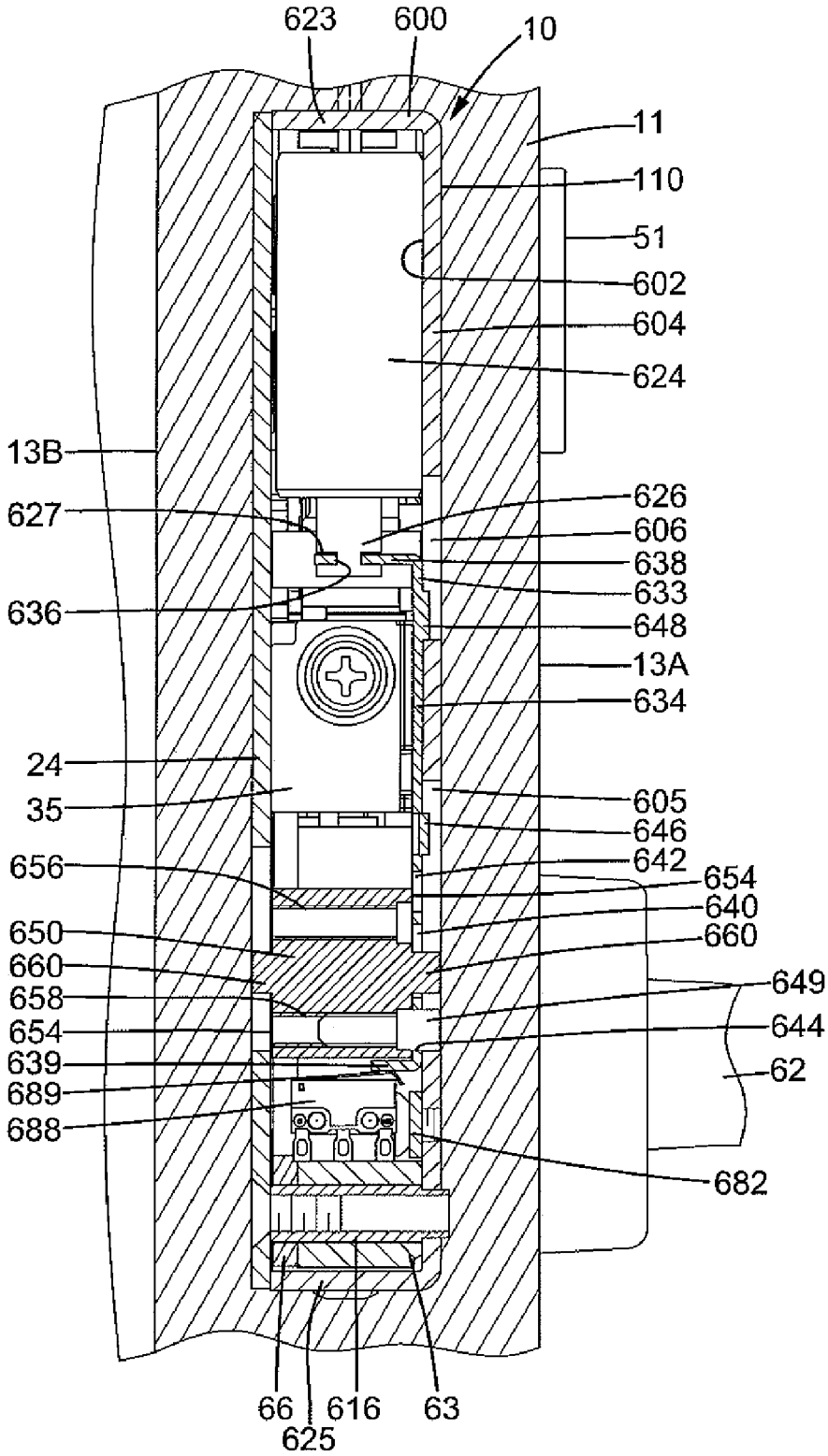
FIG. 9 shows a cross sectional view of the lock and the door of FIG. 8 according to section line 9-9 of FIG. 8.

It is noted that a spacing between first and second positioning holes 656 and 658 of locking block 650 along third axis is not equal to a spacing between first and second through-holes holes 642 and 644 of connecting member 633 along third axis Z. By changing the mounting position of locking block 650 to connecting member 633, lock 10 according to the preferred teachings of the present invention can selectively be set to be in a first mode in which lock 10 is in the locking state after electrification of driving device 624 (FIGS. 3-7) or in a second mode in which lock is in the unlocking state after electrification of driving device 624 (FIGS. 8-11). Specifically, in the first mode, first positioning hole 656 of locking block 650 is aligned with first through-hole 642 of connecting member 633, and adjusting member 649 is extended through first through-hole 642 into first positioning hole 656 to fix locking block 650. Furthermore, first detecting member 688 is so set that an open circuit is formed (first detecting member 688 is in a non-conductive state) when third section 639 of connecting member 633 presses against actuation plate 689 and that a closed circuit is formed (first detecting member 688 is in a conductive state) when actuation plate 689 is not pressed against by third section 639 of connecting member 633. Further, second detecting member 694 is so set that an open circuit is formed (second detecting member 694 is in a non-conductive state) when actuation plate 695 is pressed against by top portion 825 of stop 82 and that a closed circuit is formed (second detecting member 694 is in a conductive state) when actuation plate 695 is not pressed against by top portion 825 of stop 92. Further, when driving device 624 is not electrified, connecting member 633 is in the lower position (FIGS. 3 and 6) such that distal end 664 of locking block 650 is aligned with passageway 676 of unlocking member 666. Lock 10 is, thus, in an unlocking state. After driving device 624 is electrified, driving member 626 retracts inward and, thus, moves connecting member 633 to the upper position, moving distal end 664 of locking block 650 to a position not aligned with passageway 676 of unlocking member 666. Lock 10 is, thus, in a locking state (FIG. 7).

In the second mode, second positioning hole 658 of locking block 650 is aligned with second through-hole 644 of connecting member 633, and adjusting member 649 is extended through second through-hole 644 into second positioning hole 658 to fix locking block 650. Furthermore, first detecting member 688 is so set that a closed circuit is formed when third section 639 of connecting member 633 presses against actuation plate 689 and that an open circuit is formed when actuation plate 689 is not pressed against by third section 639 of connecting member 633. Further, second detecting member 694 is so set that a closed circuit is formed when actuation plate 695 is pressed against by top portion 825 of stop 82 and that an open circuit is formed when actuation plate 695 is not pressed against by top portion 825 of stop 92. Further, when driving device 624 is not electrified, connecting member 633 is in the lower position (FIG. 8) such that distal end 664 of locking block 650 is misaligned with passageway 676 of unlocking member 666. Lock 10 is, thus, in a locking state. After driving device 624 is electrified, driving member 626 retracts inward and, thus, moves connecting member 633 to the upper position, moving distal end 664 of locking block 650 to a position aligned with passageway 676 of unlocking member 666. Lock 10 is, thus, in an unlocking state (FIGS. 10 and 11).

Now that the basic construction of lock 10 of the preferred teachings of the present invention has been explained, the operation and some of the advantages of lock 10 can be set forth and appreciated. In particular, for the sake of explanation, it will be assumed that door 11 is closed, and lock 10 is not operated (see FIGS. 3 and 5). Furthermore, lock 10 is in the first mode (lock 10 is in the locking state after electrification of driving device 624, see FIGS. 3-7). In the first mode, when driving device 624 is not electrified (lock 10 is in the unlocking state in which unlocking member 666 can be rotated), head 31 of latch bolt 30 is in the extended, latching position (FIGS. 3 and 5), and auxiliary bolt 81 is in the retracted position. Unlocking member 666 is in the initial position (FIGS. 3, 5, 7), and connecting member 633 is in the lower position (FIGS. 3-6). Furthermore, actuation plate 689 of first detecting member 688 is pressed against by third section 639 of connecting member 633 (FIGS. 3 and 4). Distal end 664 of locking block 650 is aligned with passageway 676 of unlocking member 666 (FIG. 3). Stop 82 is in the stop position (FIG. 3) with second end 822 of stop 82 in a retraction path of head 31 of latch bolt 30 and spaced from head 31 along first axis X by a small spacing. Top portion 825 of stop 82 disengages from actuation plate 695 of second detecting member 694. Protrusion 824 of stop 82 presses against second end 832 of unlocking lever 83 such that unlocking lever 83 is in the third position (FIGS. 3 and 7). Driving rod 66 is positioned in the first position by retractor 35.

Lock 10 in the first mode shown in FIGS. 3-7 is electrically connected to a burglar alarm system 700 through first and second detecting members 688 and 694. Burglar alarm system 700 is off when the open circuit is formed due to pressing of third section 639 of connecting member 633 against actuation plate 689 of first detecting member 688. When lock 10 is in the unlocking state, outer handle 62 of outer operating device 6 can be rotated to drive unlocking member 666 to rotate from the initial position to the releasing position about second axis Y through transmission by spindle 64 (link 63 is not moved). During rotation of unlocking member 666, passageway 676 permits passage of distal end 664 of locking block 650 (extension 663 is received in passageway 676), push end 668 drives driving rod 66 to rotate from the first position to the second position about second axis Y, and second end 662 of driving rod 66 moves retractor 35 and, thus, retracts head 31 of latch bolt 30 from the extended, latching position (FIG. 3) to the retracted, unlatching position (FIG. 6) along first axis X. Sliding movement of retractor 35 along first axis X also moves first end 831 of unlocking lever 83 and, thus, rotates unlocking lever 83 from the third position (FIG. 3) to the fourth position (FIG. 6) about second axis Y. Second end 832 of unlocking lever 83 presses against protrusion 824 of stop 82 to drive stop 82 to rotate about second axis Y, moving second end 822 of stop 82 out of the retraction path of head 31 of latch bolt 30 and, thus, allowing retraction of head 31 of latch bolt 30. Furthermore, top portion 825 of stop 82 presses against actuation plate 695 of second detecting member 694. Since burglar alarm system 700 is off, refraction of head 31 of latch bolt 30 will not activate burglar alarm system 700. Thus, door 11 can be opened without activating burglar alarm system 700.

When driving device 624 is electrified by electricity supplied from power supply 696 while lock 10 is in the first mode, driving member 626 retracts (i.e., moves upward) along third axis Z, moving connecting member 633 from the lower position to the upper position along third axis Z. Third section 639 of connecting member 633 disengages from actuation plate 689 of first detecting member 688 (FIG. 7), and distal end 664 of locking block 650 is misaligned with passageway 676 of unlocking member 666. Furthermore, distal end 664 of locking block 650 presses against first side 672 of unlocking member 666, prohibiting rotational movement of unlocking member 666. Thus, lock 10 is in the locking state not allowing unlocking of lock by operating outer handle 62. When lock 10 is in the locking state 10, if head 31 of latch bolt 30 is moved to the retracted, unlatching position by a burglar such as by pricking, top portion 825 of stop 82 will press against actuation plate 695 of second detecting member 694 and, thus, activates burglar alarm system 700, which, in turn, will activate alarm light and/or siren.

Operation of lock 10 in the second mode (lock 10 is in the unlocking state after electrification of driving device 624, see FIGS. 8-11) will now be described. When door 11 is closed and driving device 624 is not electrified, actuation plate 689 of first detecting member 688 is pressed against by third section 639 of connecting member 633 such that a closed circuit is formed in first detecting member 688. Burglar alarm system 700 is turned on. Second detecting member 694 is in an open circuit, as actuation plate 695 of second detecting member 694 is not pressed against by top portion 825 of stop 82. In this case, distal end 664 of locking block 650 is misaligned with passageway 676 of unlocking member 666. Furthermore, distal end 664 of locking block 650 presses against first side 672 of unlocking member 666, prohibiting rotational movement of unlocking member 666. Thus, lock 10 is in the locking state not allowing unlocking of lock by operating outer handle 62. When lock 10 is in the locking state 10, if head 31 of latch bolt 30 is moved to the retracted, unlatching position by a burglar by such as pricking, top portion 825 of stop 82 will press against actuation plate 695 of second detecting member 694 and, thus, activates burglar alarm system 700, which, in turn, will activate alarm light and/or siren. This is because third section 639 of connecting member 633 is not disengaged from actuation plate 689 of first detecting member 688.

When driving device 624 is electrified by electricity supplied from power supply 696 while lock 10 is in the second mode, driving member 626 retracts (i.e., moves upward) along third axis Z, moving connecting member 633 from the lower position to the upper position along third axis Z. Third section 639 of connecting member 633 disengages from actuation plate 689 of first detecting member 688 (FIG. 10), and distal end 664 of locking block 650 is aligned with passageway 676 of unlocking member 666. Thus, burglar alarm system 700 is turned off due to the open circuit formed in first detecting member 688. Operation of outer handle 62 can rotate unlocking member 666 from the initial position to the releasing position through transmission by spindle 64 (link 63 is not moved). During rotation of unlocking member 666, passageway 676 permits passage of distal end 664 of locking block 650, push end 668 drives driving rod 66 to rotate from the first position to the second position about second axis Y, and second end 662 of driving rod 66 moves retractor 35 and, thus, retracts head 31 of latch bolt 30 from the extended, latching position to the retracted, unlatching position (FIG. 11) along first axis X. Thus, door 11 can be opened without activating burglar alarm system 700.

Whether lock 10 is assembled to be in the first or second mode, when a key is inserted into cylinder 51 on outer side 13A of door 11 and rotated to unlock cylinder 51, further rotation of the key causes actuating plate 512 to drive follower 52 to rotate about second axis Y, which, in turn, retracts head 31 of latch bolt 30 to the retracted, unlatching position. In a case that burglar alarm system 700 is activated, driving device 624 must be actuated to provide an open circuit in first detecting member 688 to deactivate burglar alarm system 700 by such as using a remote control to supply driving device 624 with electricity from power supply 696. Alternatively, pressing bar 42 of inner operating device 4 can be operated to drive retractor 35 for unlatching head 31 of latch bolt 30. Likewise, driving device 624 must be actuated to provide an open circuit in first detecting member 688 to deactivate burglar alarm system 700 if burglar alarm system 700 is activated.

By changing the mounting position of locking block 650 to connecting member 633 (i.e., changing the engagement relation between locking block 650 and connecting member 633) and, thus, changing operation of the first and second detecting members 688 and 694 electrically connected to burglar alarm system 700 for detecting closing or opening of door 11 and by mounting first and second detecting members 688 and 694 in case 600, the operating mode (first or second mode) of lock 10 according to the preferred teachings of the present invention can be rapidly changed while reducing the risk of bypass or deactivation of burglar alarm system 700. Supply of electricity to driving device 624 can be achieved by using a remote control, providing remote locking/unlocking of lock 10 according to the preferred teachings of the present invention, which is advantageous over conventional locks.

Now that the basic teachings of the present invention have been explained, many extensions and variations will be obvious to one having ordinary skill in the art. For example, instead of contact-type micro switches, first and second detecting members 688 and 694 can be of non-contact type photo switches or non-contact type solenoid switches. In an example in which a photo sensor having a transmitter and a receiver is used and when connecting member 633 is in the lower position, third section 639 of connecting member 633 blocks the light beam emitted by the transmitter to turn on (or turn off) burglar alarm system 700. On the other hand, when connecting member 633 is in the upper position, third section 639 of connecting member 633 does not block the light beam emitted by the transmitter to turn off (or turn on) burglar alarm system 700. In another example in which a solenoid switch is used, third section 639 of connecting member 633 approaches the solenoid to turn on (or turn off) burglar alarm system 700 when connecting member 633 is in the lower position. On the other hand, third section 639 of connecting member 633 is away from the solenoid to turn off (or turn on) burglar alarm system 700 when connecting member 633 is in the upper position.

Furthermore, lock 10 according to the preferred teachings of the present invention does not have to include cylinder 51 and follower 52. In this case, the key for operating cylinder 51 is not required. But lock 10 according to the preferred teachings of the present invention can still be operated by using a remote control to operate driving device 624 for locking/unlocking purposes or by using inner and outer operating devices 4 and 6 for unlatching purposes. Furthermore, driving device 624 can include a motor and a transmission unit having a gear and a rack. The transmission unit is coupled with driving member 626 and can be driven by the motor. Driving member 626 can be driven to move along third axis Z when the motor is activated, achieving locking/unlocking functions.

Further, outer operating device 6 can be of other forms and shape. As an example, outer operating device 6 can include a thumb piece mounted to outer side 13A of door 11 and directly coupled to link 63. Link 63 can be driven by the thumb piece to rotate about second axis Y. When link 63 is driven by the thumb piece to rotate about second axis Y, second end 632 of link 63 presses against connecting end 670 of unlocking member 666, rotating unlocking member 666 about second axis Y from the initial position to the releasing position. Driving rod 66 pivots from the first position to the second position, and head 31 of latch bolt 30 is moved from the extended, latching position to the retracted, unlatching position.

Further, first and second guiding slots 605 and 606 can be formed in lid 24, and track 243 can be formed in lateral wall 604 of case 600. In this case, locking block 650 is located between connecting member 633 and lateral wall 604. Namely, second end face 654B of locking block 650 faces lateral wall 604 while first end face 654A still faces connecting member 633. Modification to the locations of other components in space 602 to correspond to the arrangement of locking block 650 would be within the skill of the art.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A lock comprising, in combination: a case adapted to be mounted in a compartment in a door, with the case including a faceplate and a rear wall spaced from the faceplate along a first axis (X), with the case further including a lateral wall and a lid spaced from the lateral wall along a second axis (Y) perpendicular to the first axis (X), with the faceplate, the rear wall, the lateral wall, and the lid together defining a space; a latch bolt received in the space, with the latch bolt including a retractor and a head operatively connected to the retractor, with the head slideable along the first axis (X) between an extended, latching position outside of the case and a retracted, unlatching position in the case; a driving rod rotatably received in the space and including an end operatively connected to the retractor, with the driving rod pivotable about the second axis (Y) between first and second positions, with the head of the latch bolt located in the extended, latching position when the driving rod is in the first position, with the head of the latch bolt located in the retracted, unlatching position when the driving rod is in the second position; an unlocking member rotatably received in the space, with the unlocking member including a push end, with the unlocking member further including first and second sides spaced along the first axis (X), with a passageway extending from the first side through the second side, with the first side at the push end of the unlocking member abutting the driving rod, with the unlocking member adapted to be operatively connected to an outer operating device mounted to an outer side of the door, with the outer operating device operable to rotate the unlocking member about the second axis (Y) between an initial position and a releasing position, with the driving rod located in the first position when the unlocking member is in the initial position, with the driving rod located in the second position when the unlocking member is in the releasing position; a driving device mounted in the space, with the driving device including a driving member movable along the third axis (Z), with the driving device adapted to be electrically connected to a power supply and to receive electricity from the power supply for moving along the third axis (Z); a connecting member slideably received in the space and connected to the driving member to move therewith, with the connecting member being movable by the driving member between an upper position and a lower position; a locking block removably mounted to the connecting member and selectively in one of first and second engagement relations with the connecting member, with the locking block including first and second end faces and a periphery extending between the first and second end faces, with the first end face facing the connecting member, with the second end face facing one of the lateral wall and the lid of the case, with an extension extending from the periphery of the locking block and having a distal end, with the unlocking member being rotatable by the outer operating device from the initial position to the releasing position when the distal end of the locking block is aligned with the passageway of the unlocking member, wherein the lock is in an unlocking state when the extension is received in the passageway while the unlocking member in the releasing position, allowing the driving rod to rotate from the first position to the second position about the second axis (Y) and retracting the head from the extended, latching position to the retracted, unlatching position, wherein the distal end of the locking block abuts the first side of the unlocking member when the distal end of the locking block is misaligned with the passageway of the unlocking member such that the lock is in a locking state prohibiting the unlocking member from being rotated by the outer operating device; a first detecting member mounted in the space, with the connecting member operatively connected to the first detecting member to control the first detecting member to be in a conductive state or a non-conductive state, wherein the first detecting member is pressed against by the connecting member in the lower position with the first detecting member in one of the conductive state and the non-conductive state, wherein the first detecting member is not pressed against by the connecting member in the upper position with the first detecting member in the other of the conductive state and the non-conductive state; a second detecting member mounted in the space, with the second detecting member adapted to be connected to a burglar alarm system, with the head of the latch bolt operatively connected to the second detecting member to control the second detecting member to be in a conductive state or a non-conductive state, wherein the second detecting member is not pressed against by the head in the extended, latching position with the second detecting member in the non-conductive state, wherein the second detecting member is pressed against by the head in the retracted, unlatching position with the second detecting member in the conductive state, wherein when the connecting member is in the upper position, the distal end of the locking block is in one of alignment and misalignment with the passageway of the unlocking member, wherein when the connecting member is in the lower position, the distal end of the locking block is in the other of alignment and misalignment with the passageway of the unlocking member, wherein when the distal end of the locking block is in misalignment with the passageway of the unlocking member, the first detecting member is in the conductive state and turns on the burglar alarm system, wherein when the distal end of the locking block is in alignment with the passageway of the unlocking member, the first detecting member is in the non-conductive state and turns off the burglar alarm system, wherein the burglar alarm system activates an alarm when the burglar alarm system is on and the second detecting member is in the conductive state, and wherein the burglar alarm system does not activate the alarm when the burglar alarm system is on and the second detecting member is in the non-conductive state.

2. The lock as claimed in claim 1, with the connecting member further including a first through-hole, with the locking block further including a first positioning hole extending from the first end face, wherein when the connecting member is in the lower position and when the locking block is engaged with the connecting member with the first through-hole aligned with the first positioning hole, the distal end of the locking block is aligned with the passageway of the unlocking member, and the lock is in the unlocking state, and wherein when the connecting member is in the upper position and when the locking block is engaged with the connecting member with the first through-hole aligned with the first positioning hole and when the locking block is engaged with the connecting member with the first through-hole aligned with the first positioning hole, the distal end of the locking block is misaligned with the passageway of the unlocking member, and the lock is in the locking state.

3. The lock as claimed in claim 2, with the connecting member further including a second through-hole spaced from the first through-hole along the third axis (Z), with the locking block further including a second positioning hole extending from the first end face and spaced from the first positioning hole along the third axis (Z), with a spacing between the first and second through-holes along the third axis (Z) different from a spacing between the first and second positioning holes along the third axis (Z), wherein when the connecting member is in the lower position and when the locking block is engaged with the connecting member with the second through-hole aligned with the second positioning hole, the distal end of the locking block is misaligned with the passageway of the unlocking member, and the lock is in the locking state, and wherein when the connecting member is in the upper position and when the locking block is engaged with the connecting member with the second through-hole aligned with the second positioning hole, the distal end of the locking block is aligned with the passageway of the unlocking member, and the lock is in the unlocking state.

4. The lock as claimed in claim 3, with the connecting member including first, second, and third sections, with the second section and the third section spaced along the third axis (Z) and on opposite sides of the first section, with the first detecting member including a first actuation plate located below the third section of the connecting member along the third axis (Z), wherein when the connecting member is in the upper position and when the locking block is engaged with the connecting member with the first through-hole aligned with the first positioning hole, the third section is disengaged from the first actuation plate of the first detecting member to make the first detecting member in the non-conductive state, wherein when the connecting member is in the lower position and when the locking block is engaged with the connecting member with the first through-hole aligned with the first positioning hole, the third section presses against the first actuation plate of the first detecting member to make the first detecting member in the conductive state, wherein when the connecting member is in the upper position and when the locking block is engaged with the connecting member with the second through-hole aligned with the second positioning hole, the third section is disengaged from the first actuation plate of the first detecting member to make the first detecting member in the conductive state, and wherein when the connecting member is in the lower position and when the locking block is engaged with the connecting member with the second through-hole aligned with the second positioning hole, the third section presses against the first actuation plate of the first detecting member to make the first detecting member in the non-conductive state.

5. The lock as claimed in claim 4, further comprising, in combination: a stop mounted in the space and including an end and a protrusion, with the end of the stop having a top portion (825), with the stop pivotable about the second axis (Y) between a stop position and a release position; and an unlocking lever pivotably mounted in the space and including first and second ends, with the unlocking lever pivotable about the second axis (Y) between a third position and a fourth position, with the first end of the unlocking lever abutting the retractor, with the second end of the unlocking lever abutting the protrusion of the stop, with the second detection member including a second actuation plate, wherein when the head of the latch bolt is in the extended, latching position, the stop is in the stop position, the top portion (825) of the stop disengages from the second actuation plate, the unlocking lever is in the third position to make the second detecting member in the non-conductive state, wherein when the head is moved to the retracted, unlatching position, the retractor pushes the first end of the unlocking lever and moves the unlocking lever from the third position to the fourth position, the end of the stop is moved from the stop position to the release position, the top portion (825) of the stop presses against the second actuation plate to make the second detecting member in the non-conductive state.

6. The lock as claimed in claim 4, further comprising, in combination: an adjusting member, with the lateral wall of the case including a first guiding slot extending from an inner face of the lateral wall through an outer face of the lateral wall, with the connecting member having a face facing the lateral wall, with a first protrusion formed on the face of the connecting member and slideably received in the first guiding slot, with the upper and lower position of the connecting member being within a length extent of the first guiding slot along the third axis (Z), with the adjusting member selectively engaged in the first through-hole and the first positioning hole or in the second through-hole and the second positioning hole to select the first or second engagement relation of the locking block relative to the connecting member.

7. The lock as claimed in claim 6, with the lateral wall further including a second guiding slot extending from the inner face of the lateral wall through the outer face of the lateral wall, with a second protrusion formed on the face of the connecting member and slideably received in the second guiding slot, preventing the connecting member from rotating about the second axis (Y) while the connecting member is moving along the third axis (Z).

8. The lock as claimed in claim 7, with a slot extending from the face of the connecting member through another face of the connecting member, with the slot located between the first and second through-holes, with a third protrusion formed on the first end face of the locking block and slideably received in the slot of the connecting member along the third axis (Z).

9. The lock as claimed in claim 8, with the first and second through-holes and the first and second protrusions formed on the first section, with the second section including a notch, with the driving member of the driving device including an annular groove, with the notch having a peripheral edge engaged with the annular groove of the driving member, allowing joint movement of the driving member and the connecting member.

* * * * *